US012503879B1

(12) United States Patent
Kinderman et al.

(10) Patent No.: US 12,503,879 B1
(45) Date of Patent: Dec. 23, 2025

(54) JOINTS FOR PORTABLE SHELTERS

(71) Applicant: ARDISAM, INC., Cumberland, WI (US)

(72) Inventors: Trevor Kinderman, Cumberland, WI (US); Joshua James Rannells, Cumberland, WI (US); Michael Furseth, Cumberland, WI (US); Chuck Librande, Rice Lake, WI (US); Ben Nelson, Cameron, WI (US)

(73) Assignee: ARDISAM, INC., Cumberland, WI (US)

( * ) Notice: Subject to any disclaimer, the term of this patent is extended or adjusted under 35 U.S.C. 154(b) by 0 days.

(21) Appl. No.: 19/017,413

(22) Filed: Jan. 10, 2025

(51) Int. Cl.
*E04H 15/48* (2006.01)
*E04H 15/38* (2006.01)

(52) U.S. Cl.
CPC ..... *E04H 15/48* (2013.01); *E04H 15/38* (2013.01)

(58) Field of Classification Search
CPC ..... E04H 15/48; E04H 15/38
See application file for complete search history.

(56) References Cited

U.S. PATENT DOCUMENTS 2,113,118 A 4/1938 Pyatt
10,731,377 B2 * 8/2020 Cassetta ..... A45F 4/04

FOREIGN PATENT DOCUMENTS

CN 111119570 A * 5/2020
KR 100340749 B1 * 6/2002
KR 200490302 Y1 * 10/2019

* cited by examiner

*Primary Examiner* — David R Dunn
*Assistant Examiner* — Danielle Jackson
(74) *Attorney, Agent, or Firm* — PERKINS COIE LLP

(57) ABSTRACT

A foot joint assembly for a portable shelter may include a plate portion for contacting the ground, a tongue portion extending transversely from the plate portion, a first opening extending through the plate portion, a second opening extending through the tongue portion, and one or more pole receptacles pivotably attached to the tongue portion. The first opening may receive a stake for affixing the assembly to the ground. A pole receptacle may include an elongated portion for receiving a pole for the shelter frame, and a flange portion extending from the elongated portion for attachment to the tongue portion. Embodiments of the present technology further include a shelter system, a frame for a shelter system, or other structures that implement joint assemblies.

20 Claims, 8 Drawing Sheets

JOINTS FOR PORTABLE SHELTERS

BACKGROUND

A conventional portable shelter—such as a tent, blind, or gazebo—may include a frame formed with multiple poles interconnected at joints, and a flexible fabric or polymer shell supported on the frame to form a covered or enclosed interior space. Conventional shells are anchored to the ground by passing a stake through a loop or grommet attached to the shell. Typically, the flexible shell holds the frame and the shelter to the ground, such that the frame is not directly anchored to the ground. Thus, conventional portable shelters may not be adequately secured to the ground in high wind circumstances, in which the shell can be pulled from its connection to the ground. Additionally, securing the flexible shell only to the ground often results in the stakes being buried under dirt, snow, or other debris, making them difficult to locate or a hazard to passersby. Further, poles connected via conventional joints may be prone to twisting or tangling when the frame is in a stowed configuration. Aspects of embodiments of the present technology address these drawbacks and other shortcomings of conventional shelters and frame joints.

SUMMARY

Representative embodiments of the present technology include a joint assembly for a frame of a portable shelter (e.g., a foot joint assembly). In some embodiments, the joint assembly includes a plate portion for contacting the ground, a tongue portion extending transversely from the plate portion, a first opening extending through the plate portion, and one or more pole receptacles pivotably attached to the tongue portion. The first opening may receive a stake for affixing the assembly to the ground. A pole receptacle may include an elongated portion for receiving a pole for the shelter frame, and a flange portion extending from the elongated portion. The flange portion may receive a pivot shaft connected to the tongue portion, such as a fastener extending through a second opening in the tongue portion, or a tube attached to the tongue portion. Embodiments of the present technology further include a shelter system, a frame for a shelter system, or other structures that implement joint assemblies.

Other features and advantages will appear hereinafter. The features described herein may be used separately or together, or in various combinations of one or more of them.

BRIEF DESCRIPTION OF THE DRAWINGS

In the drawings, wherein the same reference number indicates the same element throughout the several views.

DETAILED DESCRIPTION

The present technology is directed to corner joints for portable shelters (e.g., foot joints), and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions may not be shown or described in detail to avoid unnecessarily obscuring the relevant description of the various embodiments. Accordingly, embodiments of the present technology may include additional elements or exclude some elements described below with reference to FIGS. 1-7, which illustrate examples of the technology.

The terminology used in this description is intended to be interpreted in its broadest reasonable manner, even though it is being used in conjunction with a detailed description of certain specific embodiments of the technology. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all the items in the list, or (c) any combination of items in the list. Unless otherwise specified, terms such as "attached" or "connected" are intended to include integral connections, as well as connections between physically separate components. Numerical adjectives including "first" and "second," or the like, as used in the present disclosure, do not convey hierarchy or specific features or functions. Rather, such numerical adjectives are intended to aid the reader in distinguishing between elements that may have similar nomenclature, but which may differ in position, orientation, or structure. Accordingly, such numerical adjectives may be used differently in the claims. For purposes of the present disclosure, a first element that is positioned "toward" an end of a second element is positioned closer to that end of the second element than to a middle or mid-length location of the second element.

Figure 1:
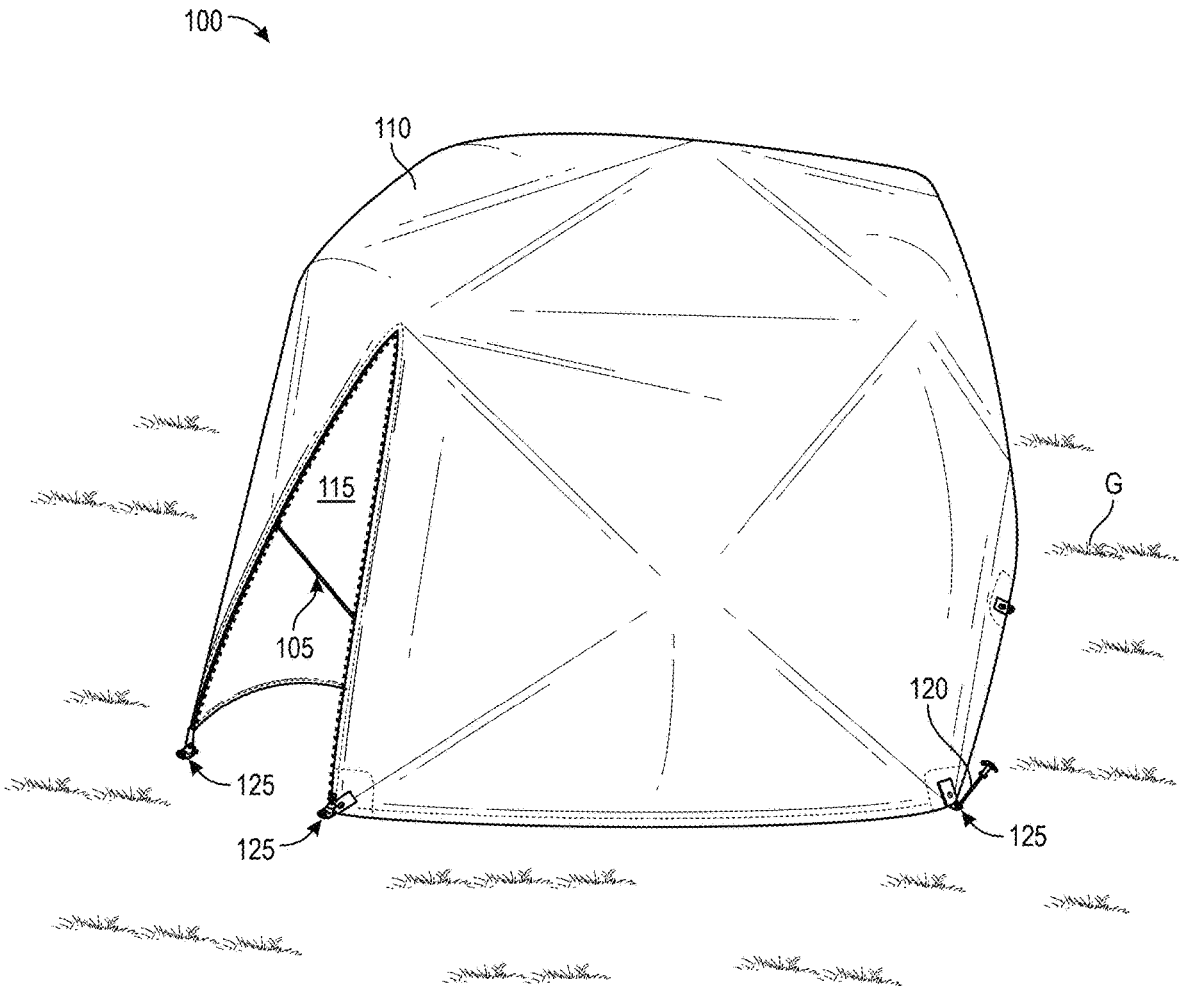
FIG. 1 illustrates a perspective view of a shelter system configured in accordance with embodiments of the present technology.

FIG. 1 illustrates a perspective view of a shelter system 100 configured in accordance with embodiments of the present technology. In FIG. 1, the shelter system 100 is in a deployed (use) configuration. In some embodiments, the shelter system 100 may include a frame 105 (only partly visible in FIG. 1) that supports a flexible shell 110 that is positionable on the frame 105 in the deployed configuration.

The flexible shell 110 forms a covered or enclosed interior space 115 suitable for camping, small events, serving as a hunting blind, or other activities, depending on the size, shape or other aspects of the shelter system 100.

Embodiments of the present technology may be scaled up or down in size to accommodate various size requirements for the interior space 115. The flexible shell 110 may be formed with any suitable material capable of conforming to the frame 105, withstanding forces applied to it from the remainder of the shelter system 100, or capable of providing a barrier to wind, light, or precipitation. Accordingly, in some embodiments, the flexible shell 110 may be made of any conventional material available for tents, hunting blinds, or other structures.

FIG. 1 also illustrates a stake 120 that passes through a portion of the frame 105 (e.g., a joint between poles) to secure the shelter system 100 to a ground surface G, as explained in detail below. Although one stake 120 is shown, the shelter system 100 may include multiple stakes 120 distributed around various corners or edges 125 of the shelter system 100. The shelter system 100 may have any suitable shape or form, and it may include any suitable openings, walls, or other features. Accordingly, the shape of a shelter system 100 disclosed herein is for context only, and applications and embodiments of the present technology are not limited to the specific example shelter disclosed herein. For example, shelter systems according to embodiments of the present technology may include tents, blinds, gazebos, partitions, or other shelter structures.

Figure 2:
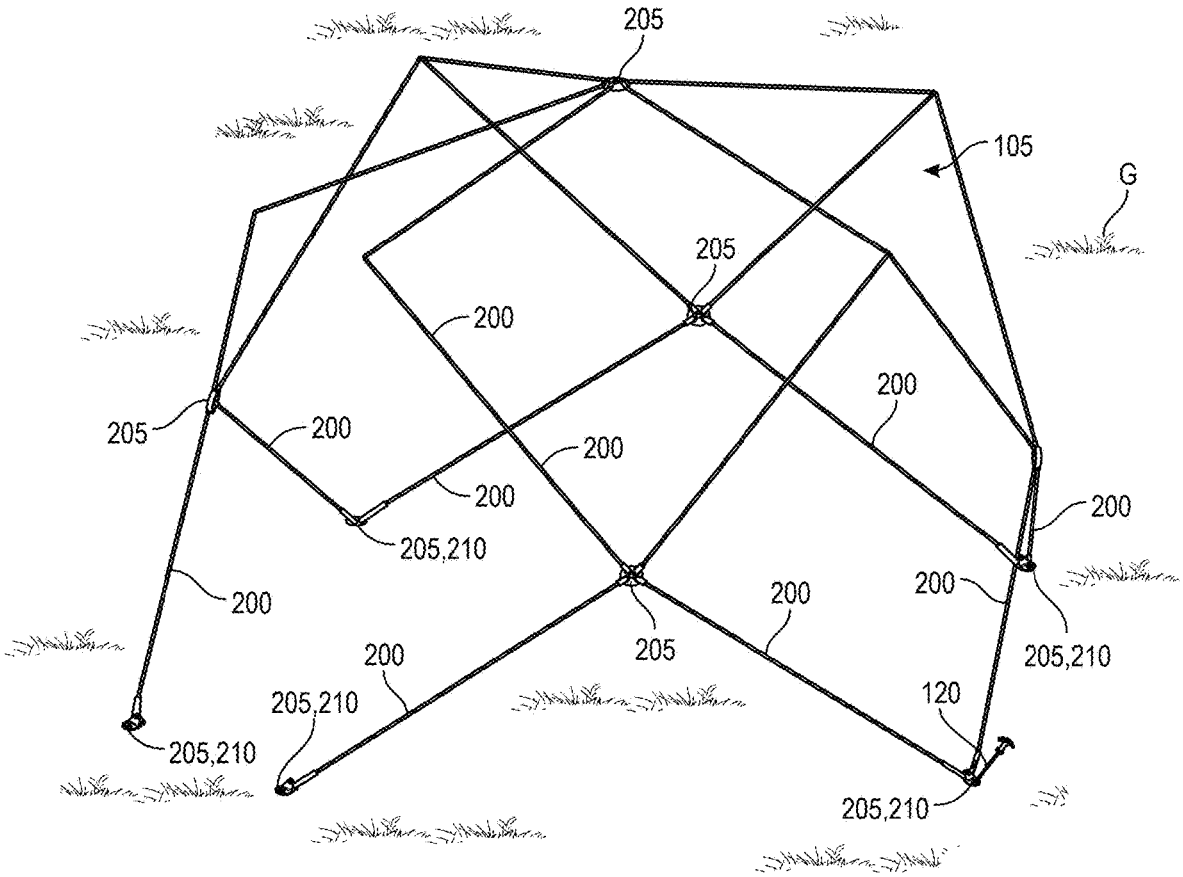
FIG. 2 illustrates a perspective view of a frame of the shelter system, in a deployed configuration.

FIG. 2 illustrates a perspective view of the frame 105 in the deployed configuration. In FIG. 2, the flexible shell 110 is omitted to show features of the frame 105. The frame 105 is stowable and deployable via the relative positioning of poles 200 interconnected with one or more joints 205. In some embodiments, the poles 200 may be pivotably connected to adjacent poles 200 via the joints 205. The poles 200 may be permanently connected to the joints 205 or they may be separable from the joints 205. The shape and configuration of the frame 105 may vary depending on implementations and needs for the shelter system 100. Accordingly, the shape and configuration of the frame 105 in FIG. 2 is for context and for example only.

In some embodiments, one or more of the joints 205 may include foot joint assemblies 210 for connecting one or more (e.g., two or more) poles 200 and the flexible shell 110 to the ground surface G via one or more of the stakes 120. The stakes 120 may pass through the foot joint assemblies 210 to secure the frame 105, the flexible shell 110, and the overall shelter system 100 to the ground surface G.

Figure 3:
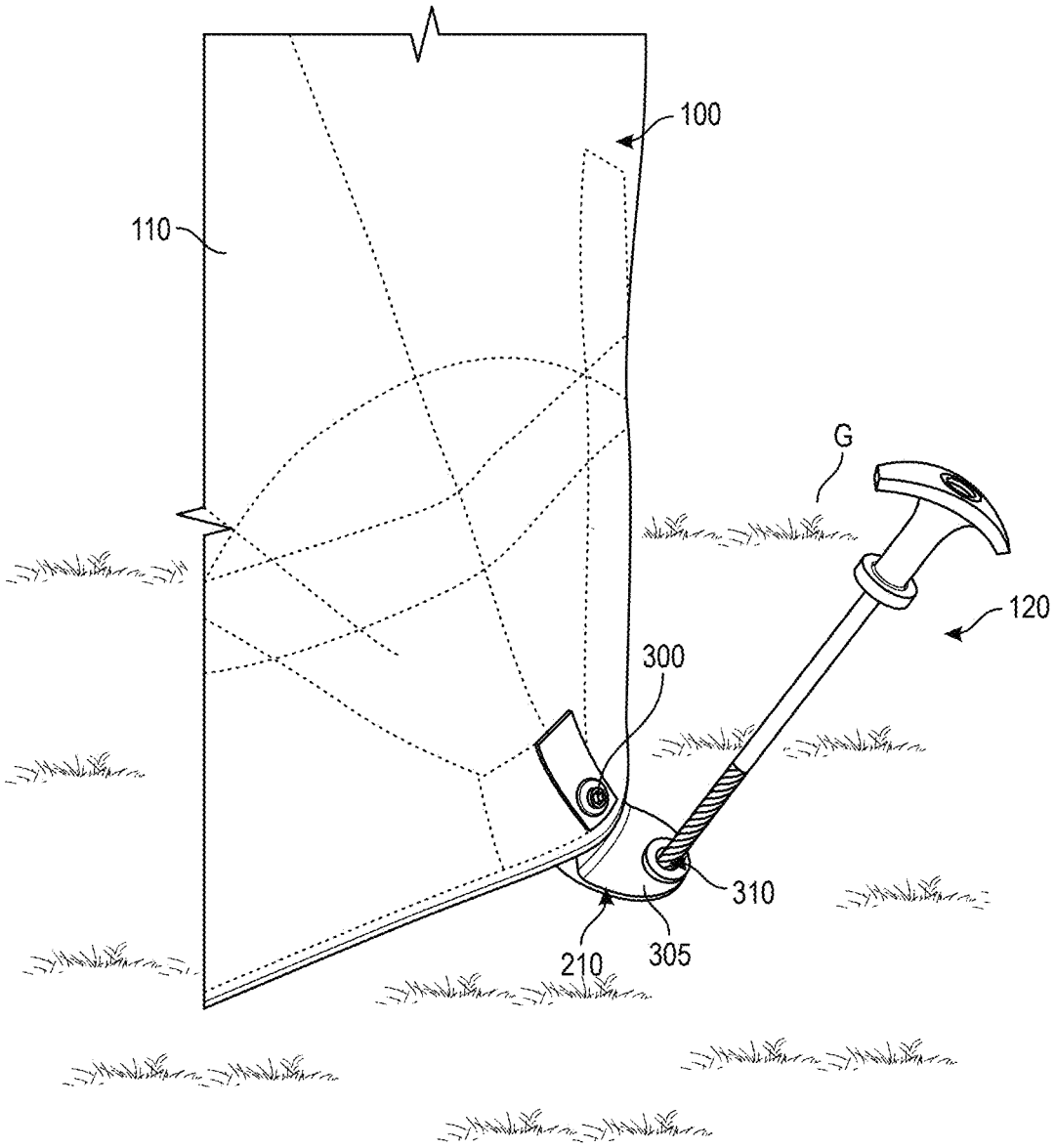
FIG. 3 illustrates an exterior detailed perspective view of a portion of the shelter system.

FIG. 3 illustrates an exterior detailed perspective view of a portion of the shelter system 100, configured in accordance with embodiments of the present technology. In particular, FIG. 3 shows a foot joint assembly 210 staked to the ground G using one of the stakes 120. The stake 120 may penetrate as far or as little into the ground G as necessary to secure the shelter system 100 or to reduce an extent that the stake 120 protrudes from the ground G.

In some embodiments, the flexible shell 110 may be attached to the foot joint assembly 210, for example, via a grommet attached to, or an opening in, the flexible shell 110. The foot joint assembly 210 may include a fastener 300 (e.g., a threaded fastener) for attaching the flexible shell 110 to the foot joint assembly 210 (e.g., through the grommet or opening in the flexible shell 110). Accordingly, in some embodiments, the flexible shell 110 may be attached to the foot joint assembly 210, while the stake 120 secures the foot joint assembly 210 to the ground G, rather than having the stake 120 extend through the flexible shell 110 or having the flexible shell 110 directly attached to the stake 120.

In some embodiments, the foot joint assembly 210 includes a base 305 with an opening 310 through which the stake 120 may pass before piercing the ground G or otherwise becoming secured to the ground G (e.g., by threading or any other suitable connection between a stake 120 and the ground G).

Figure 4:
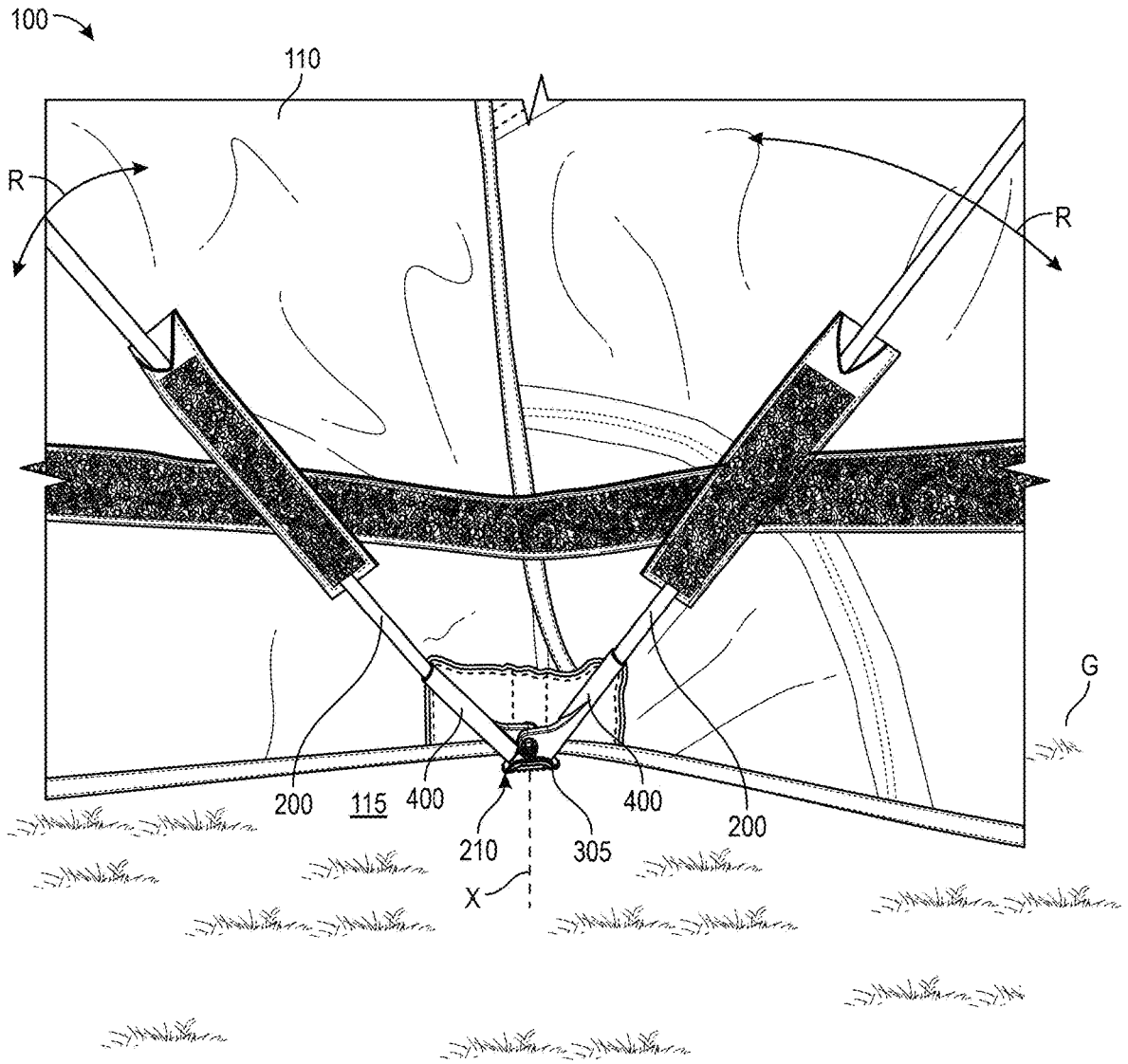
FIG. 4 illustrates an interior perspective view of a portion of the shelter system.

FIG. 4 illustrates an interior detailed perspective view of a portion of the shelter system 100. Two poles 200 may be pivotably connected via one of the foot joint assemblies 210. The flexible shell 110 may be attached to or supported on the poles 200 in a suitable manner (e.g., via sleeves in, or attached to, the flexible shell 110 that receive the poles 200). The foot joint assembly 210 rests on, or is attached to, the ground G (e.g., via a stake 120 as shown in FIG. 3). The foot joint assembly 210 may include the base 305 and one or more (e.g., two) pole receptacles 400. The pole receptacles 400 are pivotable relative to the base 305 about an axis X (e.g., back and forth along the pathways marked "R" in FIG. 4).

In some embodiments, the poles 200 may be positioned in openings within the pole receptacles 400, as generally shown in FIG. 4. In other embodiments, the pole receptacles 400 may support or be connected to the poles 200 in another manner suitable for securely providing a connection between the poles 200 and the pole receptacles 400. The poles 200 pivot toward and away from each other about the axis X between the stowed and deployed configurations of the shelter system 100.

Figure 5:
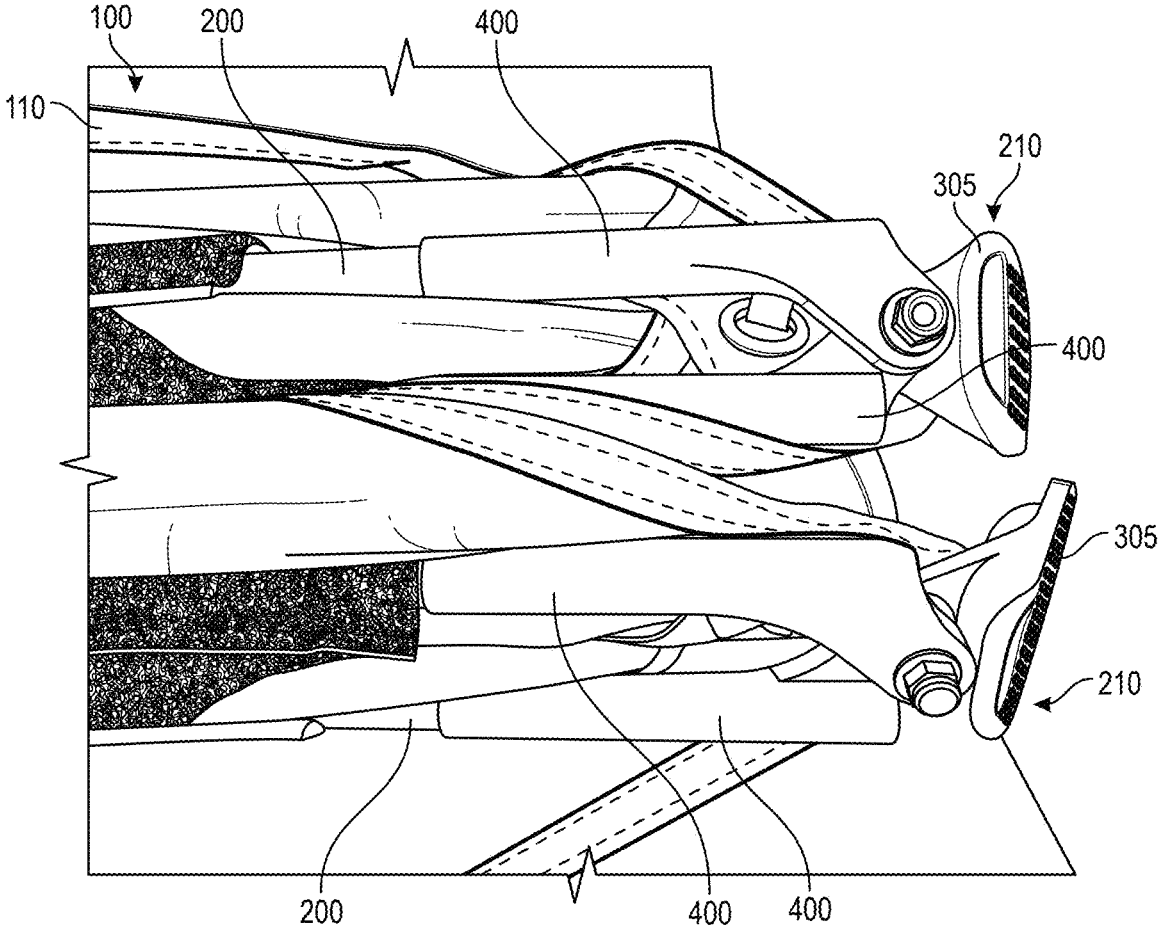
FIG. 5 illustrates a side view of a portion of the shelter system, in a stowed configuration.

FIG. 5 illustrates a side view of a portion of the shelter system 100 in a stowed configuration. In such a configuration, the flexible shell 110 may remain attached to the foot joint assemblies 210 while the poles 200 pivot toward being generally parallel to each other, thereby folding the flexible shell 110 around and between the poles 200.

Figure 6A:
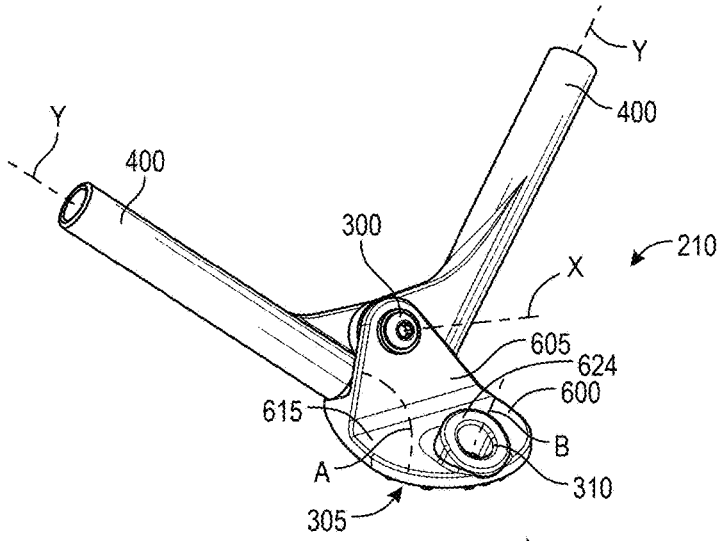
FIG. 6A illustrates a front upper perspective view of a foot joint assembly configured in accordance with some embodiments of the present technology.
Figure 6B:
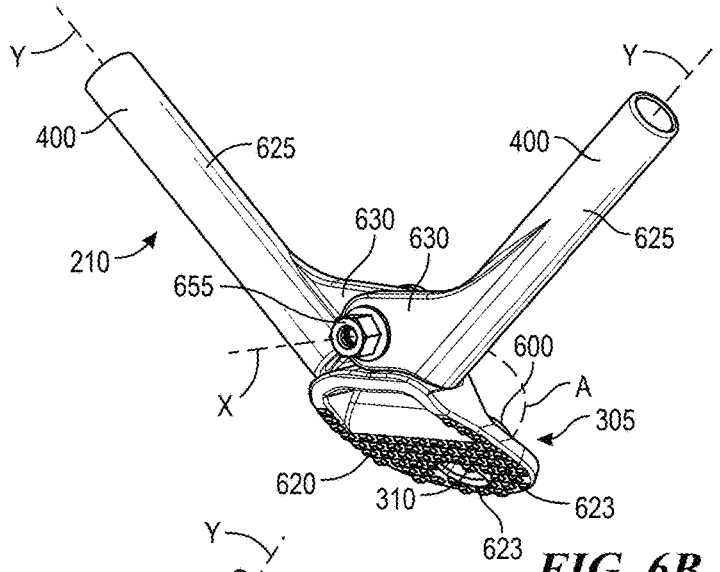
FIG. 6B illustrates a rear lower perspective view of the foot joint assembly shown in FIG. 6A.
Figure 6C:
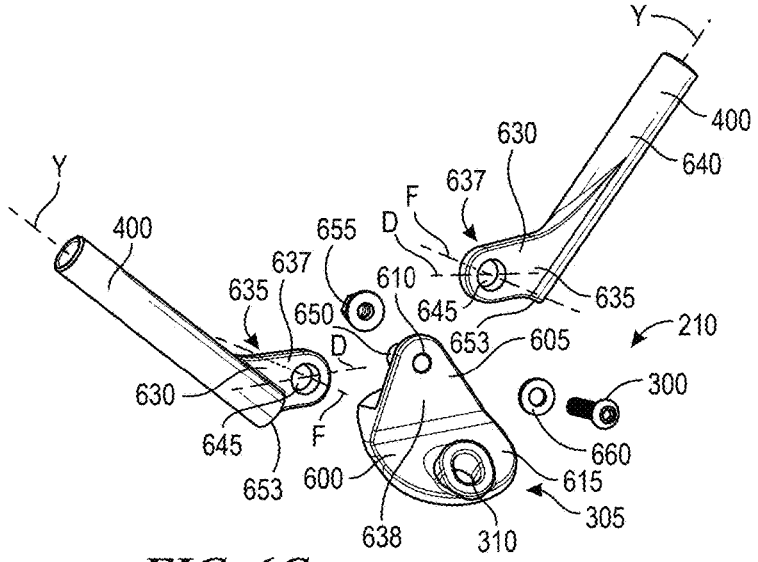
FIG. 6C illustrates a front upper exploded view of the foot joint assembly shown in FIG. 6A.
Figure 6D:
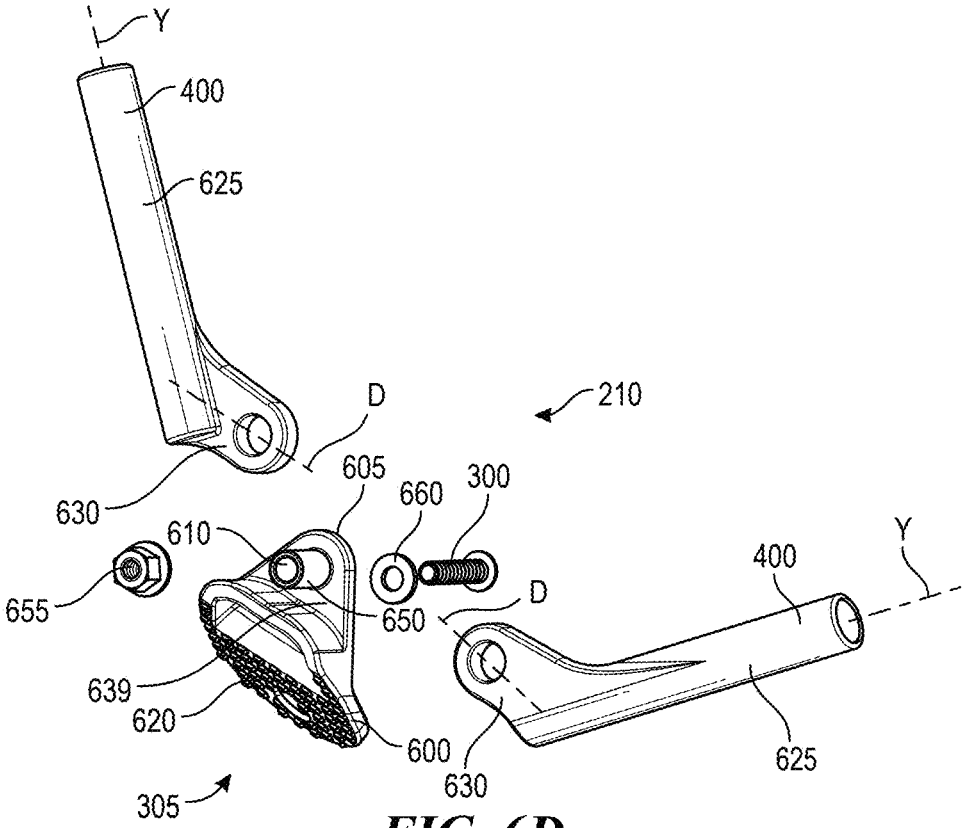
FIG. 6D illustrates a rear lower exploded view of the foot joint assembly shown in FIG. 6A.

FIG. 6A illustrates a front upper perspective view of the foot joint assembly 210. FIG. 6B illustrates a rear lower perspective view of the foot joint assembly 210. FIG. 6C illustrates a front upper exploded view of the foot joint assembly 210. FIG. 6D illustrates a rear lower exploded view of the foot joint assembly 210.

With reference to each of FIGS. 6A, 6B, 6C, and 6D, the base 305 may include a generally planar plate portion 600, a tongue portion 605 formed as a projection extending transversely from the plate portion 600, the opening 310 through the plate portion 600, and a second opening 610 through the tongue portion 605. The plate portion 600 may have a greater length and width in a horizontal plane than a thickness normal to the horizontal plane. The base 305 includes an upper surface 615 (from which the tongue portion 605 extends) and a lower surface 620 (for contacting the ground G). In some embodiments, the foot joint assembly 210 is hollow between the tongue portion 605 and the lower surface 620 (see FIG. 6B), which may reduce an amount of material required to make the base 305.

The stake 120 (see FIG. 3) is configured to pass through the opening 310 to secure the foot joint assembly 210 against the ground surface G. In some embodiments, the tongue portion 605 forms an obtuse angle A (see FIGS. 6A and 6B) relative to the upper surface 615, with the tongue portion 605 leaning away from the opening 310. In some embodiments, the lower surface 620 comprises gripping elements 623, such as knurling or one or more cleats, for engaging the ground surface G and resisting sliding along the ground surface G. In some embodiments, with reference to FIG. 6A, the plate portion 600 includes a tubular extension 624 extending upwardly from the upper surface 615. The opening 310 may extend through the tubular extension 624 along a central axis B, which may be oblique to the upper surface 615, such that the opening 310 guides the stake 120 to penetrate the ground at an oblique angle.

Each pole receptacle 400 may include an elongated portion (e.g., a tubular portion) 625 and a flange portion 630. The flange portion 630 extends from the elongated portion 625 along a direction D (see FIGS. 6C, 6D) transverse to (e.g., oblique to) a longitudinal axis Y of the elongated portion 625. Each flange portion 630 may also be offset from the longitudinal axis Y such that each flange portion 630 is asymmetrically positioned on its corresponding pole receptacle 400 (e.g., asymmetrically positioned relative to the longitudinal axis Y of the elongated portion 625). Such asymmetric positioning is especially visible in FIGS. 6A and 6C. This offset arrangement facilitates overlapping the flange portions 630 against each other and against the tongue portion 605 (e.g., to optionally result in the longitudinal axes Y of the elongated portions 625 intersecting each other when the pole receptacles 400 are fastened to the tongue portion 605).

With reference to FIG. 6C, in some embodiments, each flange portion 630 may have a surface 635 that is tangent to a cylindrical surface 640 of the elongated portion 625. Each flange portion 630 may have an opposing surface 637 opposite the tangent surface 635. The opposing surfaces 637 may form bearing surfaces that face each other or slide against each other as the pole receptacles 400 pivot relative to each other. In some embodiments, the surfaces 635, 637 may be parallel to each other and parallel to a surface of the tongue portion 605 (e.g., surface 638 in FIG. 6C or surface 639 in FIG. 6D).

Each flange portion 630 includes an opening 645 for receiving a pivot shaft 650 (see FIG. 6D), about which the pole receptacles 400 may pivot. The opening 645 may extend through the flange portion 630 along an axis F (see FIG. 6C) that is coaxial with the pivot axis X in an assembled foot joint assembly 210. The axis F may be transverse to (e.g., perpendicular to), and spaced apart from, the longitudinal axis Y of the elongated portion 625. In some embodiments, the axis F may be positioned along the longitudinal axis Y beyond a terminal end 653 of the elongated portion 625.

In some embodiments, the pivot shaft 650 may include a tube or rod extending from the tongue portion 605 along a direction away from the opening 310. In some embodiments, the pivot shaft 650 may include the second opening 610 for receiving a fastener (such as the fastener 300) to secure the pole receptacles 400 to the tongue portion 605. In some embodiments, therefore, the pivot shaft 650 functions as a bushing about which the pole receptacles 400 may pivot, with the fastener 300 shrouded within the pivot shaft 650. The fastener 300 may engage a nut 655 and one or more optional washers 660 to reduce friction among the components. In some embodiments, the tube or rod forming the pivot shaft 650 may be separate from the tongue portion 605, such that the fastener 300 holds the pivot shaft 650 (and the flange portions 630) in place. In some embodiments, the tube or rod forming the pivot shaft 650 may be omitted, such that the fastener 300 itself may be the pivot shaft about which the pole receptables 400 pivot. The fastener 300 may include a threaded or unthreaded rod, so long as it secures the pole receptacles 400 to the tongue portion 605.

In some embodiments, the pole receptacles 400 may be identical to each other, which simplifies manufacturing. As seen in the figures (e.g., FIG. 6C), the same pole receptacle 400 may be flipped for use on either side of the foot joint assembly 210.

Figure 6E:
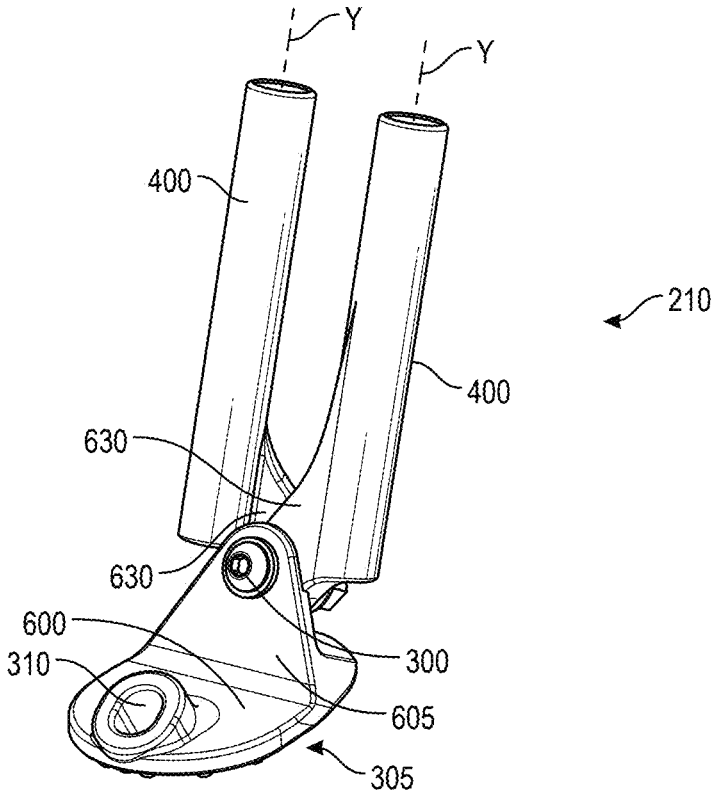
FIG. 6E illustrates a front upper perspective view of the foot joint assembly shown in FIG. 6A, in a configuration consistent with a stowed configuration of a shelter.

The pole receptacles 400 are pivotable between open and stowed configurations. FIG. 6A shows the foot joint assembly 210 in an open configuration (e.g., during deployment of the foot joint assembly 210 or the shelter system 100). FIG. 6E illustrates a front upper perspective view of the foot joint assembly 210 in a stowed configuration. In the stowed configuration the longitudinal axes Y may be parallel or nearly parallel to each other. In the deployed configuration (e.g., FIG. 6A), the longitudinal axes Y may be transverse to each other (e.g., they may intersect each other). The pole receptacles 400 may pivot relative to each other and relative to the base 305 in a single plane.

In some embodiments, the foot joint assembly 210 includes a structure or mechanism for limiting how far the pole receptacles 400 may pivot away from the parallel/stowed position. For example, with reference to FIG. 6B, the plate portion 600 may interfere with each pole receptacle 400 (e.g., the terminal end 653 of the elongated portion 625 or a surface of the flange portion 630) to prevent the pole receptacles 400 from pivoting farther outward.

Figure 7:
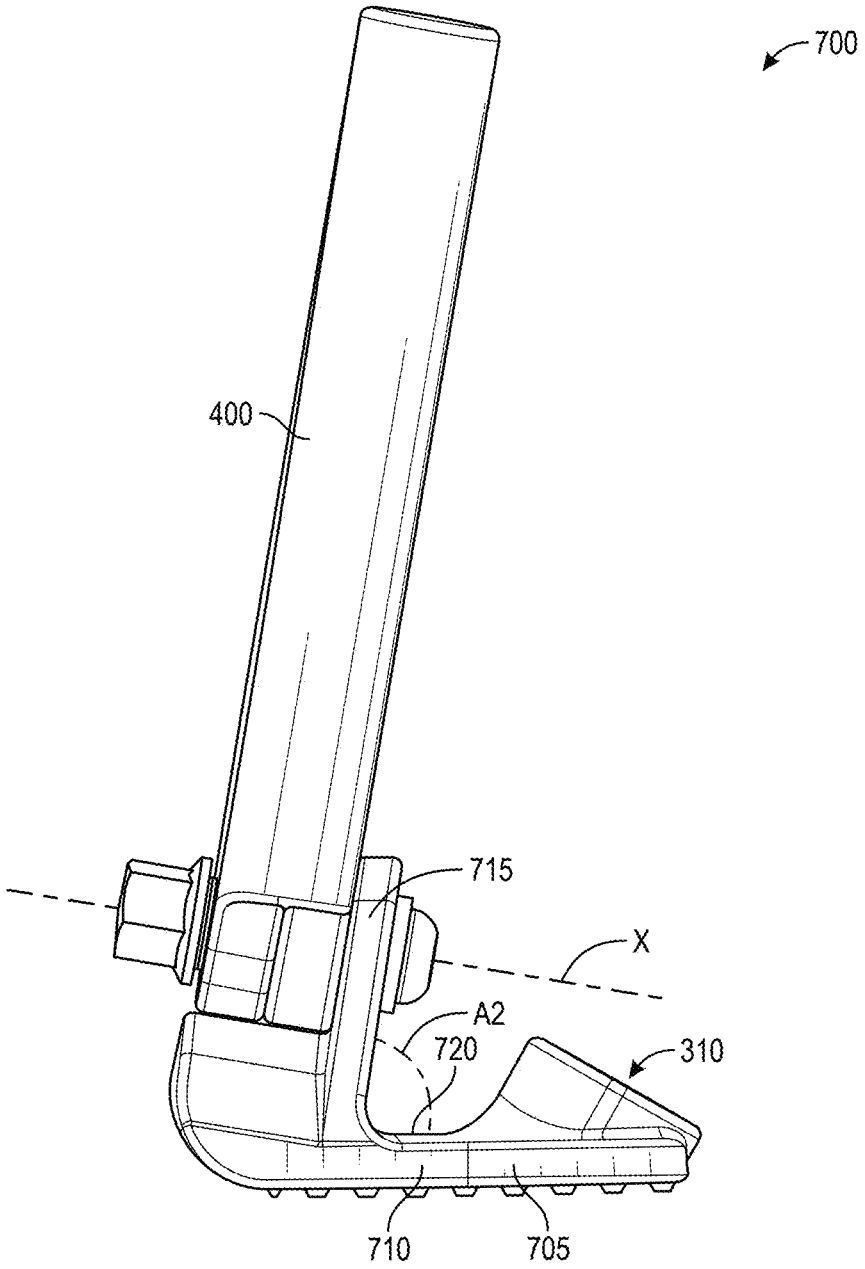
FIG. 7 illustrates a side perspective view of a foot joint assembly configured in accordance with additional embodiments of the present technology.

FIG. 7 illustrates a side perspective view of a foot joint assembly 700 configured in accordance with additional embodiments of the present technology. The foot joint assembly 700 may be generally similar to the foot joint assembly 210 illustrated and described with regard to FIGS. 1-6E. For example, the foot joint assembly 700 may include one or more pole receptacles 400 that pivot relative to a base 705. The base 705 may include a plate portion 710 and a tongue portion 715. The base 705 may be generally similar to the base 305 described above, but the tongue portion 715 may be oriented at an acute angle A2 relative to an upper surface 720 of the base 305 (i.e., the tongue portion 715 may lean toward the opening 310). Such an orientation of the tongue portion 715 provides an alternative foot joint assembly that may be implemented in suitable portions of a shelter frame that require such an angle.

In operation, the pole receptacles 400 are pivotable toward and away from each other relative to the tongue portions 605, 715, facilitated by the connection between the flange portions 630 and the tongue portion 605, 715 at the pivot shaft 650. The shell may be attached to the foot joint assembly 210, 700. Foot joint assemblies configured in accordance with embodiments of the present technology provide more rigid connections to the ground than conventional shelter feet or bases, reduce movement of the shelter in severe weather, enable a user to more easily locate stakes (because they pass through and partially reside above the feet), reduce shell contact with the ground (keeping the shell clean), and other advantages. When a shelter is stowed and deployed, the geometry of the flange portions 630, pole receptacles 400, and tongue portion 605, 715 maintain alignment of the poles and resist twisting and tangling.

From the foregoing, it will be appreciated that specific embodiments of the presently disclosed technology have been described herein for purposes of illustration, but that various modifications may be made without deviating from the scope of the technology. Certain aspects of the technology described in the context of particular embodiments may be combined or eliminated in other embodiments. Further, while advantages associated with certain embodiments of the presently disclosed technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

What is claimed is:

1. A shelter system comprising:

a stowable and deployable frame comprising a plurality of poles;

a flexible shell positionable on the frame, wherein when the frame is in a deployed configuration and the flexible shell is on the frame, the flexible shell and the frame form a covered or enclosed interior space; and a joint assembly for connecting two of the poles, wherein the joint assembly comprises a base and two pole receptacles;

wherein:

the base comprises a plate portion, a tongue portion extending transversely from the plate portion, a first opening through the plate portion, and a second opening through the tongue portion;

the plate portion comprises a tubular extension;

the first opening extends through the tubular portion;

each pole receptacle comprises an elongated portion and a flange portion having a third opening, wherein for each pole receptacle, (i) the flange portion extends from the elongated portion along a direction transverse to a longitudinal axis of the elongated portion, and (ii) one of the poles of the two poles is attachable to, or positionable in, the elongated portion; and the two pole receptacles are pivotably attached to the tongue portion via a shaft extending through each of the third openings.

2. The shelter system of claim 1, wherein, for each pole receptable, the flange is asymmetrically positioned relative to the longitudinal axis of the elongated portion.

3. The shelter system of claim 1, wherein, for each pole receptacle, a surface of the flange portion is tangent to a cylindrical surface of the elongated portion.

4. The shelter system of claim 1, wherein the pole receptacles are identical.

5. The shelter system of claim 1, wherein:

for each pole structure, the flange portion has a bearing surface extending in a plane; and the bearing surfaces face each other or contact each other.

6. The shelter system of claim 5, wherein the bearing surfaces are parallel to a surface of the tongue portion.

7. The shelter system of claim 1, wherein the shaft comprises a threaded fastener.

8. The shelter system of claim 1, further comprising a tube attached to, extending from, or in contact with a surface of the tongue portion, wherein the second opening extends through the tube.

9. The shelter system of claim 1, wherein the pole receptacles are pivotable between a first configuration in which the longitudinal axes of the elongated portions are parallel, and a second configuration in which the longitudinal axes of the elongated portions are transverse to each other.

10. The shelter system of claim 1, wherein the longitudinal axes of the elongated portions intersect each other when the pole receptacles are in the deployed configuration.

11. The shelter system of claim 1, wherein the deployed configuration comprises an end of each elongated portion or a surface of each flange contacting the plate portion, wherein the plate portion limits pivoting of the pole receptacles.

12. The shelter system of claim 1, further comprising a stake, wherein the stake is positionable to pass through the first opening to affix the base to a surface.

13. The shelter system of claim 1, wherein a central axis of the tubular extension is oblique to the plate portion.

14. The shelter system of claim 1, wherein a surface of the plate portion opposite the tongue portion comprises cleats for engaging a surface adjacent to the frame.

15. The shelter system of claim 1, wherein the tongue portion is angled toward the first opening, relative to the plate portion.

16. The shelter system of claim 1, wherein the tongue portion is angled away from the first opening, relative to the plate portion.

17. A shelter system comprising:

a stowable and deployable frame comprising a plurality of poles;

a flexible shell positionable on the frame, wherein when the frame is in a deployed configuration and the flexible shell is on the frame, the flexible shell and the frame form a covered or enclosed interior space; and a joint assembly for connecting two of the poles, wherein the joint assembly comprises a base and two pole receptacles;

wherein:

the base comprises a plate portion, a tongue portion extending transversely from the plate portion, a first opening through the plate portion, and a second opening through the tongue portion;

each pole receptacle comprises an elongated portion and a flange portion having a third opening, wherein for each pole receptacle, (i) the flange portion extends from the elongated portion along a direction transverse to a longitudinal axis of the elongated portion, and (ii) one of the poles of the two poles is attachable to, or positionable in, the elongated portion;

the deployed configuration comprises an end of each elongated portion or a surface of each flange contacting the plate portion, wherein the plate portion limits pivoting of the pole receptacles; and the two pole receptacles are pivotably attached to the tongue portion via a shaft extending through each of the third openings.

18. The shelter system of claim 17, wherein, for each pole receptable, the flange is asymmetrically positioned relative to the longitudinal axis of the elongated portion.

19. A shelter system comprising:

a stowable and deployable frame comprising a plurality of poles;

a flexible shell positionable on the frame, wherein when the frame is in a deployed configuration and the flexible shell is on the frame, the flexible shell and the frame form a covered or enclosed interior space; and a joint assembly for connecting two of the poles, wherein the joint assembly comprises a base and two pole receptacles;

wherein:

the base comprises a plate portion, a tongue portion extending transversely from the plate portion, a first opening through the plate portion, and a second opening through the tongue portion;

the tongue portion is angled toward the first opening, relative to the plate portion;

each pole receptacle comprises an elongated portion and a flange portion having a third opening, wherein for each pole receptacle, (i) the flange portion extends from the elongated portion along a direction transverse to a longitudinal axis of the elongated portion, and (ii) one of the poles of the two poles is attachable to, or positionable in, the elongated portion; and the two pole receptacles are pivotably attached to the tongue portion via a shaft extending through each of the third openings.

20. A shelter system comprising:

a stowable and deployable frame comprising a plurality of poles;

a flexible shell positionable on the frame, wherein when the frame is in a deployed configuration and the flexible shell is on the frame, the flexible shell and the frame form a covered or enclosed interior space; and a joint assembly for connecting two of the poles, wherein the joint assembly comprises a base and two pole receptacles;

wherein:

the base comprises a plate portion, a tongue portion extending transversely from the plate portion, a first opening through the plate portion, and a second opening through the tongue portion;

the tongue portion is angled away from the first opening, relative to the plate portion;

each pole receptacle comprises an elongated portion and a flange portion having a third opening, wherein for each pole receptacle, (i) the flange portion extends from the elongated portion along a direction transverse to a longitudinal axis of the elongated portion, and (ii) one of the poles of the two poles is attachable to, or positionable in, the elongated portion; and the two pole receptacles are pivotably attached to the tongue portion via a shaft extending through each of the third openings.

* * * * *